US006941678B2

(12) United States Patent
Park

(10) Patent No.: US 6,941,678 B2
(45) Date of Patent: Sep. 13, 2005

(54) SENSOR ASSEMBLY FOR AUTOMATIC DRYER

(75) Inventor: Soo Won Park, Sacheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/622,453

(22) Filed: Jul. 21, 2003

(65) Prior Publication Data

US 2004/0211083 A1 Oct. 28, 2004

(30) Foreign Application Priority Data

Apr. 28, 2003 (KR) ..... 10-2003-0026744

(51) Int. Cl.[7] ..... F26B 19/00
(52) U.S. Cl. ..... 34/528; 34/604
(58) Field of Search ..... 34/527, 528, 604, 34/606; 307/650, 651

(56) References Cited

U.S. PATENT DOCUMENTS 4,385,452 A * 5/1983 Deschaaf et al. ..... 34/562
4,899,464 A 2/1990 Carr et al.
5,940,986 A * 8/1999 Jelinek et al. ..... 34/528
6,141,887 A * 11/2000 Chen et al. ..... 34/475

FOREIGN PATENT DOCUMENTS

| | | | | |
|---|---|---|---|---|
| EP | 1 236 826 A2 | | 9/2002 | |
| GB | 1 466 505 | * | 3/1977 | ..... D06F/57/00 |
| JP | 61-232899 | * | 10/1986 | ..... D06F/58/28 |
| WO | WO 97/32071 A1 | | 9/1997 | |
| WO | WO 02/057533 A1 | | 7/2002 | |

* cited by examiner

*Primary Examiner*—Stephen Gravini
(74) *Attorney, Agent, or Firm*—McKenna Long & Aldridge LLP

(57) ABSTRACT

A sensor assembly is provided for an automatic drying machine having a rotatable drum containing a load of wet clothes to be dried wherein at least one sensing element is disposed on a surface of an elongated sensor body and is exposed to inside of the drum so as to make contact with the wet clothes. The sensor body is secured directly to a bulkhead having an air outlet opening and is provided at the air outlet opening for effective engagement with the wet clothes.

23 Claims, 15 Drawing Sheets

SENSOR ASSEMBLY FOR AUTOMATIC DRYER

CROSS-REFERENCE TO RELATED APPLICATIONS

This application claims the benefit of the Korean Application No. P2003-0026744 filed on Apr. 28, 2003, which is hereby incorporated by reference as is fully set forth herein.

BACKGROUND OF THE INVENTION

1. Field of the Invention

The present invention relates to dryers, and more particularly, to a sensor assembly for determining dryness of a load of wet clothes being dried in an automatic dryer.

2. Background of the Related Art

The automatic dryer dries a wet state drying object (for an example, clothes and the like) having washing thereof completed, automatically. In general, the dryers, having a system for supplying hot air heated by a heater to a drum for drying, are sorted as exhaust type dryers and condensing type dryers.

The exhaust type dryer dries the drying object by discharging air having carried out the drying to have a low temperature and to become humid to an exterior, drawing fresh airs heating the air, and supplying the heated air to the drum.

The condensing type dryer dries the drying object by condensing the air having carried out the drying to have a low temperature and to become humid, for removing moisture therefrom, heating, and supplying to the drum again.

In general, both the exhaust, and condensing type dryers employ an operating method in which a heater and a blower are operated for a preset time period for drying the drying object in the drum. However, the dryers having employed the method have the following problems.

The drying of different kinds of drying objects having different materials, weights, volumes, moisture contents, and the like by the same operating method for the preset time period causes to fail to provide an optimal drying performance, always. That is, there can be an occasion when drying of some of the drying objects is not finished even if operation of the dryer is finished, when re-operation of the dryer is required.

The failure in constant provision of the optimal drying performance leads the dryer set to operate for a longer time period, to require a much drying time period and a long time operation of the heater, and blower motor more than required, to result in waste of energy.

Taking the foregoing problems into account, introduction of a feed back system is required, in which the dryer is operated after dryness or humidity of laundry is sensed and provided to a controller during drying, an optimal operation condition is calculated based on information obtained by sensing, and setting of a heating quantity of the heater, a blowing rate of the blower, a rotation speed of the drum, an operation time period, and the like are changed.

In order to introduce the foregoing feed back system, a sensor is required for sensing dryness or humidity of the laundry. However, since the drum keeps rotating during operation, it is required to fit the sensor such that a stable exchange of electrical signals between the sensor and the controller is possible. Consequently, for the introduction of the feed back system, a solution for a sensor fitting structure is also required, as well.

SUMMARY OF THE INVENTION

Accordingly, the present invention is directed to a sensor assembly for an automatic dryer that substantially obviates one or more of the problems due to limitations and disadvantages of the related art.

An object of the present invention designed owing to the foregoing requirements lies on providing a sensor assembly for an automatic dryer that can provide a structure in which a sensor is fitted to an inside of the dryer for sensing dryness or humidity of laundry and transmitting to a controller during drying of the laundry so that a feed back system can be introduced to the dryer.

Another object of the present invention is to provide a sensor assembly which can be assembled easily, and replaceable at a low cost.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, a sensor assembly for an automatic dryer having a rotatable drum containing a load of wet clothes to be dried includes a bulkhead having an air outlet opening that exhausts humidified air from the drum, an electrical non-conductive sensor body secured directly to the bulkhead and positioned so as to cover a portion of the air outlet opening, and at least one sensing element disposed on a first surface of the sensor body. The sensing element is exposed to inside of the drum so as to make contact with the wet clothes for measuring moisture content and temperature of the clothes.

The sensor body described above includes an extension member extended from a second surface (opposite to the first surface exposed to the inside of the drum) of the sensor body. Also, a first mounting bracket having an aperture provided thereon is extended from the bulkhead and the extension member is inserted into the aperture for slip fit engagement with the first mounting bracket. The extension member of the sensor body may include a detent which engages with the first mounting bracket to prevent the extension member from being disengaging from the first mounting bracket.

In addition, a first end of the sensor body may include a first screw hole adapted to receive a first screw for securing the first end directly to the bulkhead, and a second end of the sensor body may include a second screw hole adapted to receive a second screw for securing the second end to a mounting bracket extended from the bulkhead. Alternatively, the first end of the sensor body may include a slot adapted to receive a thin portion of the bulkhead for securing the first end to the thin portion of the bulkhead.

The sensor assembly described above further includes a perforated air outlet grill secured to the bulkhead where the air outlet grill covers the remaining portion of the air outlet opening. The air outlet grill may include a caved channel formed on a lower circumferential edge of the air outlet grill for receiving the sensor body where the first surface of the sensor body is slopped away from a surface of the air outlet grill to thereby project into the inside of the drum for improved contact with the wet clothes. In addition, the sensor body includes a groove formed on an upper edge of the first surface and the air outlet grill includes a ridge that engages with the groove for pressing down the upper edge of the first surface so as to prevent disengagement of the sensor body from the caved channel of the air outlet grill.

In further aspect of the present invention, an automatic dryer comprises a cabinet, a drum rotatably provided in the cabinet for containing a load of wet clothes to be dried, a rear bulkhead comprising an air inlet opening that exhausts dry air into the drum, and a front bulkhead comprising an air outlet opening that exhausts humidified air from the drum. The automatic dryer further comprises an electrically non-conductive sensor body secured directly to the front bulkhead and positioned so as to cover a portion of the air outlet opening, at least one sensing element disposed on a first surface of the sensor which is exposed to inside of the drum so as to make contact with the wet clothes, and a perforated air outlet grill being rigidly secured to the from the front bulkhead for covering the remaining portion of the air outlet opening.

The sensor body included in the automatic dryer may include an extension member extended from a second surface (opposite to the first surface) of the sensory body. A first mounting bracket having an aperture formed thereon is extended from the front bulkhead so that the extension member can be inserted into the aperture for slip engagement with the first mounting bracket. The extension member of the sensor body may include a detent which engages with the first mounting bracket to prevent the extension member from being disengaged from the first mounting bracket.

In addition, a first end of the sensor body may include a first screw hole adapted to receive a first screw for securing the first end directly to the bulkhead, and a second end of the sensor body may include a second screw hole adapted to receive a second screw for securing the second end to a mounting bracket extended from the bulkhead. Alternatively, the first end of the sensor body may include a slot adapted to receive a thin portion of the bulkhead for securing the first end to the thin portion of the bulkhead.

The sensor body may further include a groove formed on an upper edge of the first surface and the air outlet grill may include a ridge that engages with the groove for pressing down the upper edge of the first surface so as to prevent disengagement of the sensory body from the caved channel of the air outlet grill. The first surface of the sensor body is slopped away from the surface of the air outlet grill to thereby project into the inside of the drum for improved contact with the wet clothes.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. Wherever possible, the same reference numbers will be used throughout the drawings to refer to the same or like parts.

Figure 1:
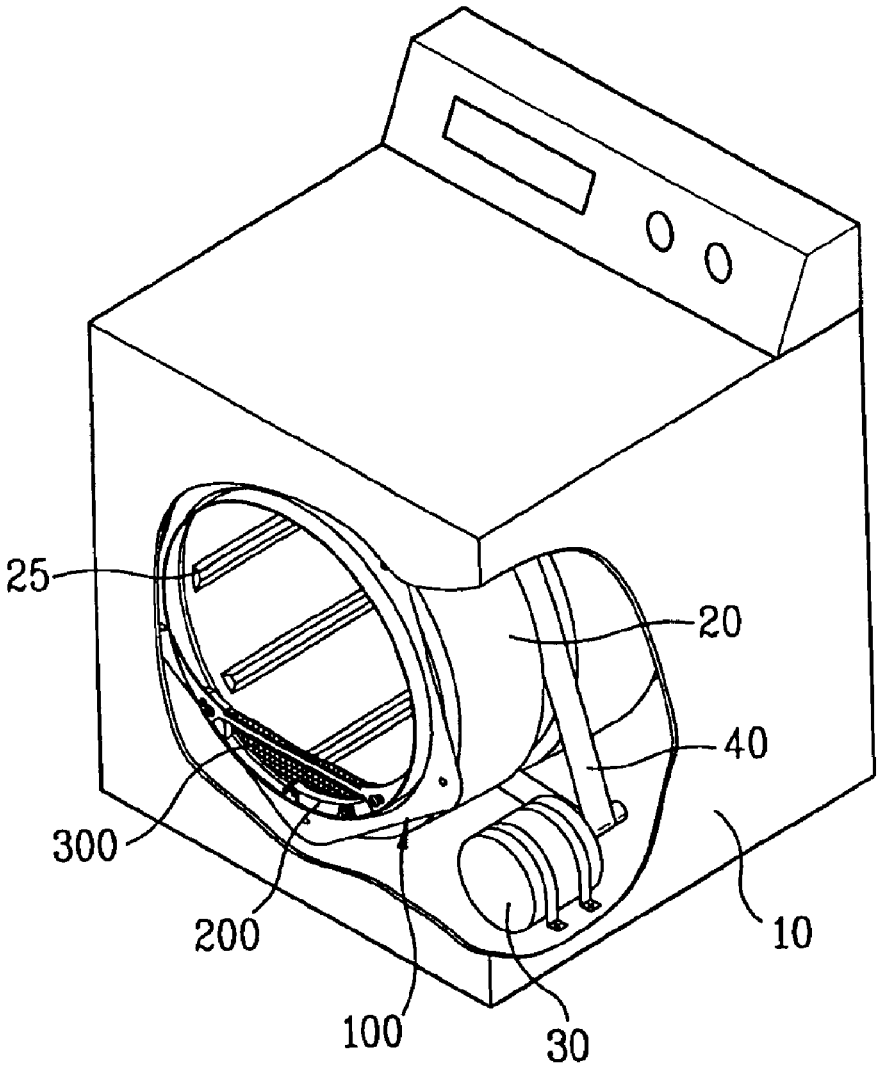
FIG. 1 illustrates a perspective view with a partial cut away view for showing an inside of a dryer in accordance with a preferred embodiment of the present invention.
Figure 2:
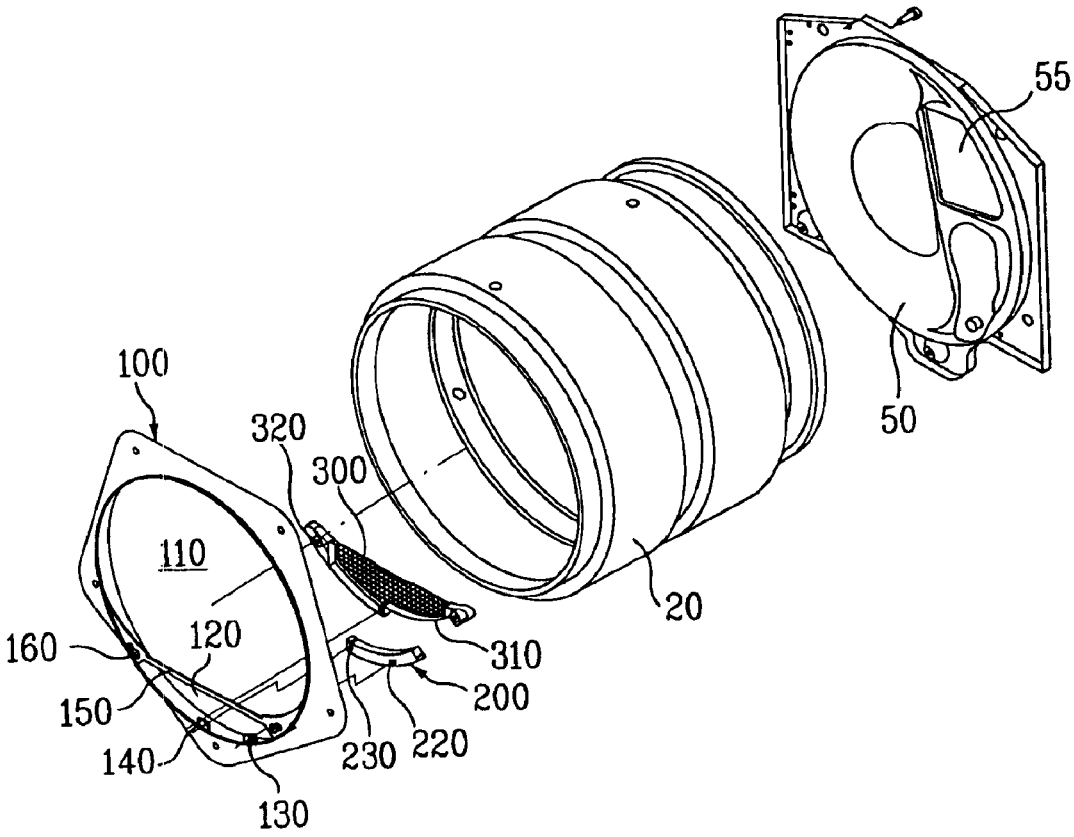
FIG. 2 illustrates a perspective disassembled view showing assembly of some of components of the dryer in accordance with a preferred embodiment of the present invention.

FIG. 1 illustrates a perspective view with a partial cut away view for showing an inside of a dryer in accordance with a preferred embodiment of the present invention, and FIG. 2 illustrates a perspective disassembled view showing assembly of some of components of the dryer in accordance with a preferred embodiment of the present invention.

Referring to FIGS. 1 and 2, a drum 20 is rotatably provided to a cabinet 10 of a dryer shown in FIG. 1. For this, a belt 40 connects a motor 30 and the drum 20 provided to an inside of the cabinet 10. According to this system, since the belt 40 transmits a power from the motor 30 to the drum 20, the drum 20 can rotate inside of the cabinet 10.

The drum 20 has tumbling ribs 25 provided to an inside circumferential surface thereof for lifting and dropping the drying objects held inside of the drum 20 when the drum rotates.

Opposite ends of the drum 20 are opened, to which a front bulkhead 100 and a rear bulkhead 50 are provided adjacently. The front bulkhead 100 and the rear bulkhead 50 are fixed to the cabinet 10 or a supporting member provided to an inside of the cabinet 10, and not rotatable with the drum 20.

The rear bulkhead 50 has an air inlet opening 55 for introduction of hot air heated by the heater (not shown) into the drum 20. As shown in FIG. 2, the front bulkhead 100 has two openings; one for exhausting air from an inside of the drum 20, and the other for serving as an introduction opening for introduction/taking drying objects into/out of the drum 20 through the opening when a door (not shown) of the dryer is opened. The two openings are divided by a dividing member 150. For convenience of description, the opening serving as the introduction opening is called as a first opening 110, and the opening serving as an air exhaust opening is called as an air outlet opening 120.

Provided to the air outlet opening is an air outlet grill 300 for prevention of the drying objects held inside of the drum 20 from escaping therethrough, and a sensor 200 for measuring information on an inside of the drum 20, for an example, humidity or temperature of the drying object. The air outlet grill 300 and the sensor 200, provided to the air outlet opening 120, are mounted on and fixed to the front bulkhead 100, respectively.

Figure 3:
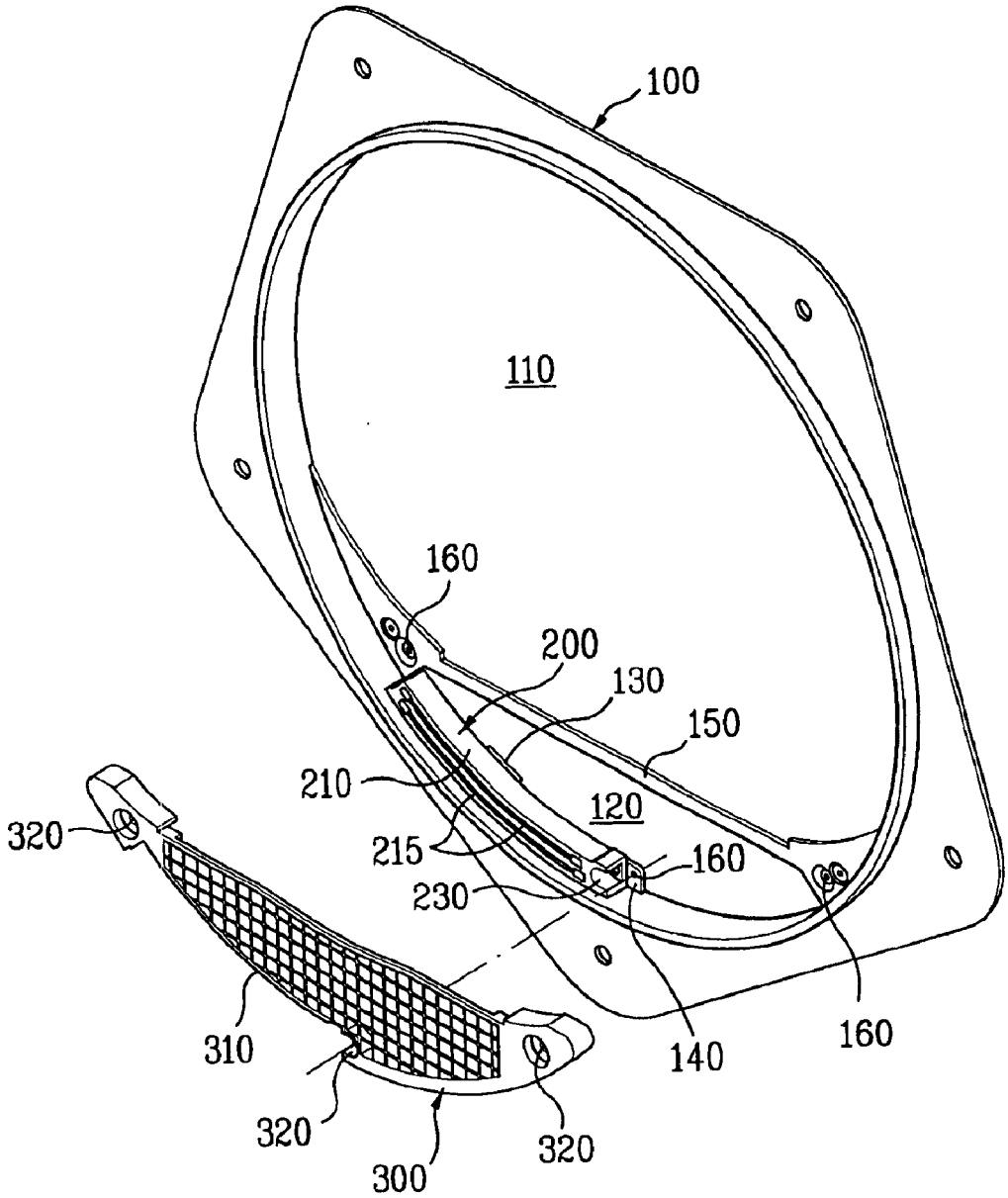
FIGS. 3 and 4 illustrate perspective views each seen from an inside of a drum showing the sensor and the air outlet grill in FIG. 2 respectively mounted to a front bulkhead.
Figure 4:
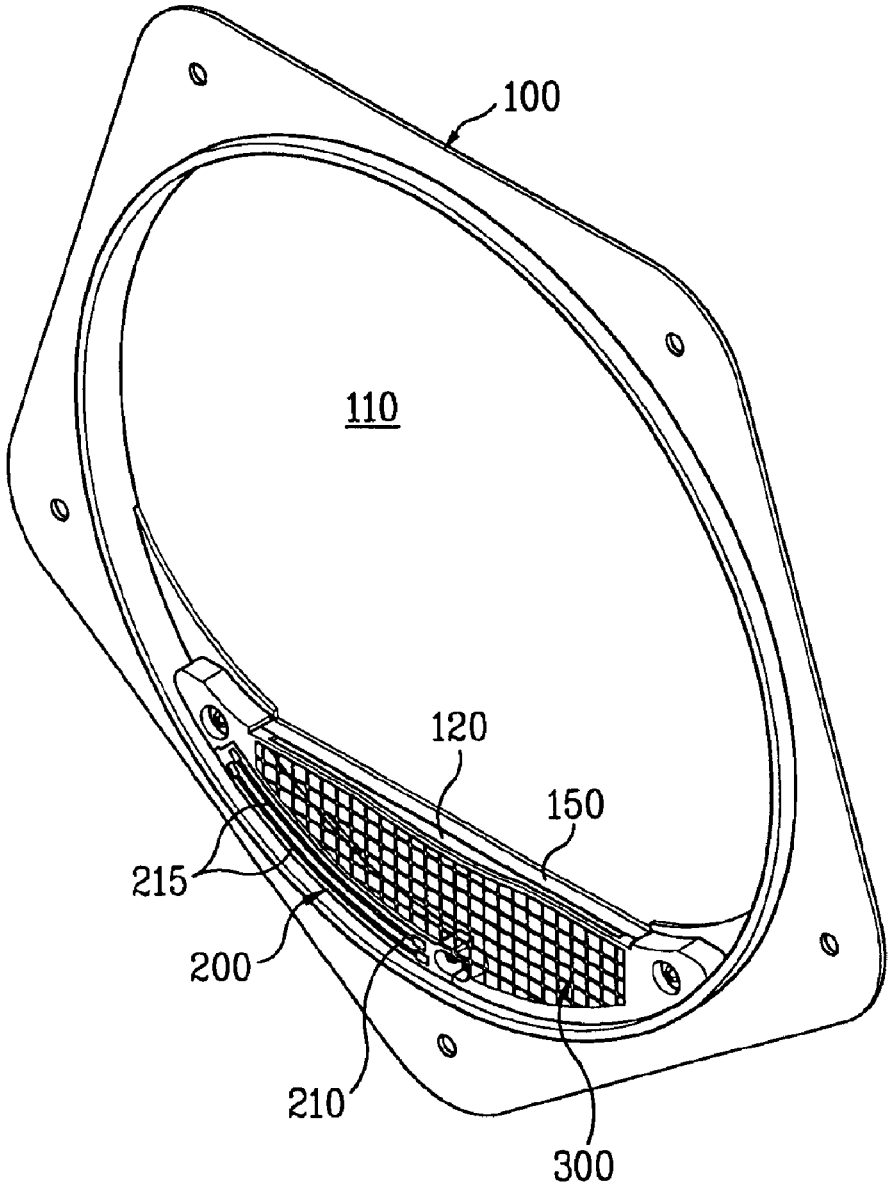

FIGS. 3 and 4 illustrate perspective views each seen from an inside of a drum 20 showing the sensor 200 and the air outlet grill 300 in FIG. 2 respectively mounted to an air outlet opening 120 in a front bulkhead 100, as an example. As shown, the sensor 200 is mounted to an inside circumference of the front bulkhead 100 to occupy an area of the air outlet opening 120, and the air outlet grill 300 is mounted on the front bulkhead 100 after the sensor 200 is mounted on the front bulkhead 100 so that the air outlet grill 300 covers an entire remained area of the air outlet opening 120 excluding a portion of area occupied by the sensor 200. Meanwhile, the sensor 200 and the air outlet grill 300 respectively mounted to the front bulkhead 100 are not attached or fixed to each other.

The sensor 200 thus mounted includes electrically non-conductive sensor body 210, a sensing element, and fastening means. The sensing element, provided for sensing a temperature and humidity of the drying object, includes, for an example, an electrode 215 for coming into direct contact with, for an example, air or the drying object inside of the drum 20 and measuring moisture content of the drying object. The sensing element is provided to a surface of the sensor body 210 facing the inside of the drum 20 for easy and direct contact with air or the drying object inside of the drum 20. In the meantime, the fastening means, provided for mounting the sensor 200 on the front bulkhead 100, provides a variety of embodiments of the sensor mounting structure as the fastening means has a variety of systems. In the meantime, FIGS. 3 and 4 are exemplary, and do not limit the structure of the fastening means of the present invention.

The air outlet grill 300 has a grill structure in which a plurality of members are crossed for free pass of air. As shown in FIG. 3, the air outlet grill 300 has a caved channel 310 formed in a form of a channel in a part of an outer circumferential surface for preventing interference with the sensor 200 when the air outlet grill 300 is provided to the air outlet opening 120.

The air outlet grill 300 also includes air outlet grill fastening means for easy mounting of the air outlet grill 300 to the front bulkhead 100. In FIGS. 3 and 4, one example of the air outlet grill fastening means, a plurality of first pass through holes 320 are shown. In a case the first pass through holes 320 are provided to the air outlet grill 300, second pass through holes 160 in correspondence to the first pass through holes 320 are provided to the front bulkhead 100. The first and second pass through holes 320 and 160 are screw holes. When the correspondent first and second pass through holes 320 and 160 are provided to the air outlet grill 300 and the front bulkhead 100 respectively, the air outlet grill 300 can be fastened to the front bulkhead 100 with screws or the like firmly, after the air outlet grill 300 is mounted on the front bulkhead 100 to cover the air outlet opening 120, as shown in FIG. 4, once the air outlet grill 300 is fastened, the sensor 200 and the air outlet grill 300 can be respectively fastened to the front bulkhead 100 independently, because the caved channel 310 in the air outlet grill 300 secure a space for the sensor 200.

However, the air outlet grill fastening means is not limited to the first pass through holes 320 shown in FIGS. 3 and 4. A plurality of hooks on the air outlet grill 300 and hook holes in the front bulkhead 100 for receiving the hooks may work as the fastening means. Therefore, the air outlet grill fastening means is not limited to the first pass through holes 320, but any structure that can fasten the air outlet grill 300 to the front bulkhead 100 is adequate for the air outlet grill fastening means.

A variety of embodiments of a structure in which the sensor 200 is mounted to the front bulkhead 100 depending on a variety of the fastening means provided to the sensor 200 will be described in more detail, with reference to drawings.

Figure 5:
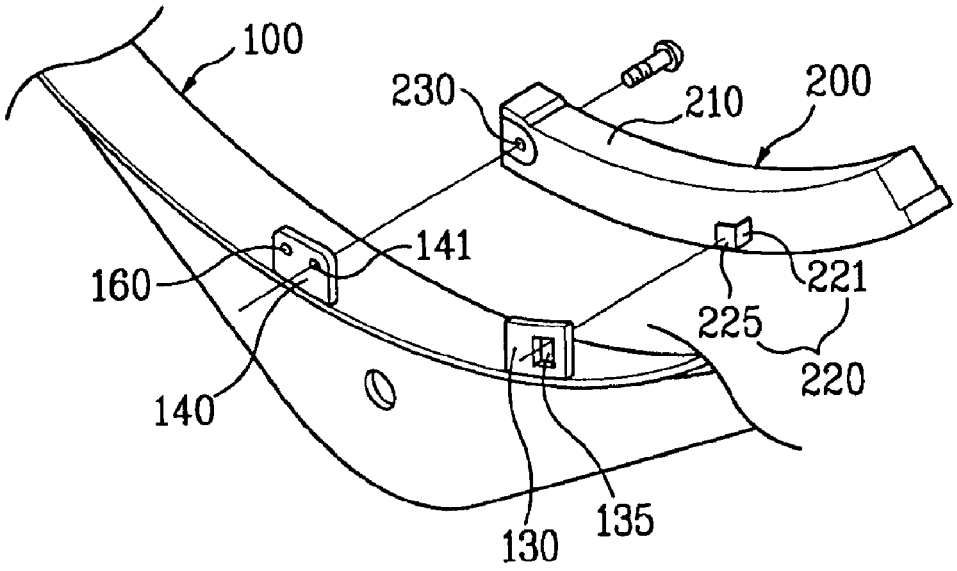
FIG. 5 illustrates a perspective disassembled partial view seen from an outside of a drum showing mounting of a sensor in accordance with a first preferred embodiment of the present invention.

FIG. 5 illustrates a perspective disassembled partial view seen from an outside of the drum 20 showing mounting of the sensor 200 inclusive of first fastening means on the front bulkhead 100 in accordance with a first preferred embodiment of the present invention.

Referring to FIG. 5, the first fastening means includes an 'L' extension member provided to one surface of the sensor body 210, for an example, a surface opposite to a surface the electrode is mounted thereon. The extension member 220 provided as the first fastening means is fastened to the front bulkhead 100 by means of elastic force and friction force.

FIG. 5 shows an example of an aperture 135 provided to a first mounting bracket 130 extended from the front bulkhead 100 vertical to an inside circumferential surface of the front bulkhead 100, i.e., a surface the sensor 200 is mounted thereon. In more detail, an example is shown, in which the extension member 220 includes a vertical part 221 projected from the sensor body 210, and a horizontal part 225 bent in one direction at an end of the vertical part 221. For reference, the unexplained reference symbol 216 denote terminals of the electrode 215 shown in FIGS. 3 and 4.

The sensor 200 having the foregoing extension member 220 is fastened by inserting the extension member 220 in the aperture 135 and pushing in a direction of the horizontal part 225. That is, the extension member 220 is inserted into the aperture 135 for slip fit engagement with the first mounting bracket 130. On doing so, the first mounting bracket 130 is inserted between the horizontal part 225 of the extension member 220 and the sensor body 210 tightly as shown in FIGS. 6~7B.

Figure 6:
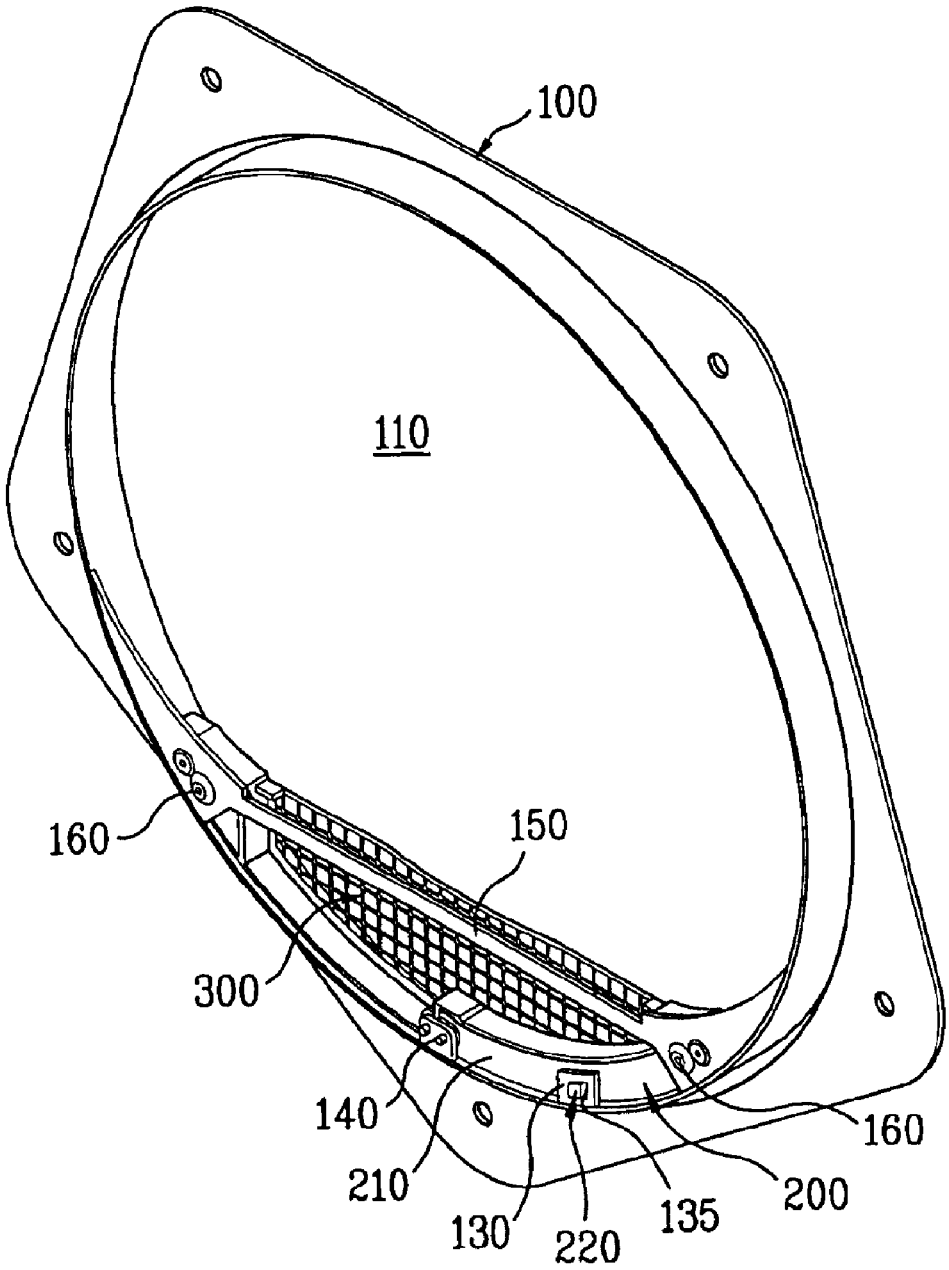
FIG. 6 illustrates a perspective view showing the sensor mounted.
Figure 7A:
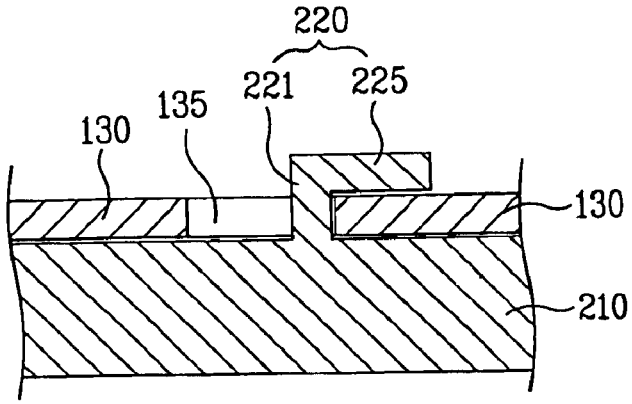
FIGS. 7A, 7B, and 7C illustrate cross-sections showing different embodiments of the first fastening means.
Figure 7B:
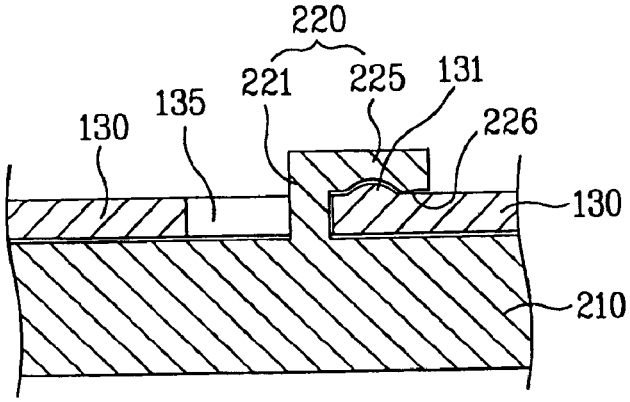

Referring to FIG. 6, according to this operation, the sensor 200 is securely fastened to the front bulkhead 100 by an elastic force of the extension member 220, and friction forces at surfaces the extension member 220 and the first mounting bracket 130 are in contact, and the first mounting bracket 130 and the sensor body 210 are in contact. For the secure fastening of the sensor 200, it is preferable that a thickness of the first mounting bracket 130 is equal to, or slightly greater than a distance between the horizontal part 225 of the extension member 220 and the sensor body 210.

The present invention also provides a structure for preventing the sensor 200 once fastened to the front bulkhead 100 from being disengaged from the front bulkhead 100 easily due to vibration and the like. Referring to FIG. 7B, first and second detents 226 and 131 are provided to the extension member 220 and the first mounting bracket 130 for prevention of disengagement. The first detent 226 provided to the extension member 220 is projected from the horizontal part 225 of the extension member 220 toward the sensor body 210. The second detent 131 is projected from the first mounting bracket 130 toward the horizontal part 225 so as to be positioned between the vertical part 221 of the extension member 220 and the first detent 226. Once the first and second detents 226 and 131 are provided, movement of the sensor 200 is prevented by the first and second detents 226 and 131 even if an external force, such as vibration or the like, is occurred after the sensor 200 is mounted. In the meantime, as another embodiment, a structure may be possible in which at least one projection and recess for receiving the projection are provided to the extension member 220 and the first mounting bracket 130.

Figure 7C:
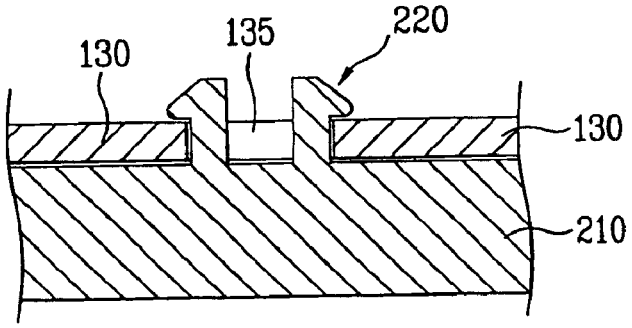

In the meantime, the first fastening means of the sensor 200 is not limited to above embodiment. That is, as shown in FIG. 7C, the first fastening means may include two extension members 220, and a wedge form at an end of each of the extension members 220 for easy insertion of the extension member 220 into the aperture 135. As shown in FIG. 7C, the fastening means permits firm fastening of the sensor 200 as the extension members 220 are elastically deformed toward a center of the aperture 135 when the extension member is inserted into the aperture 135 for slip fit engagement with the first mounting bracket 130, and restored again when the wedge forms pass the aperture 135.

Though the first fastening means can be fastened to the aperture 135 in the first mounting bracket 130 extended from the front bulkhead 100, the first fastening means may be fastened to the front bulkhead 100, directly. If an aperture is formed in an inside circumferential surface of the front bulkhead 100, and the first fastening means is provided to a surface of the sensor 200 which is brought into contact with the inside circumferential surface of the front bulkhead 100, according to a principle as above, the sensor 200 can be mounted on the front bulkhead 100. Therefore, positions of the first fastening means illustrated in FIGS. 5 and 6 are exemplary, and do not limit the position of the first fastening means in the present invention.

In the meantime, referring to FIGS. 5 and 6, the sensor 200 is provided with second fastening means, further. The second fastening means is provided for maintaining a fastened state more firmly after the sensor 200 is fastened by using the first fastening means. FIGS. 5 and 6 illustrate examples of a first screw hole 230 provided to one end of the sensor 200 as the second fastening means. In a case the first screw hole 230 is provided to the sensor 200 thus, a second screw hole 141 is provided to the front bulkhead 100 in correspondence to the first screw hole 230. In this instance, as shown in FIGS. 5 and 6, the second screw hole 141 is provided to a second mounting bracket 140 extended from the front bulkhead 100 vertical to an inside circumferential surface of the front bulkhead 100, a surface the sensor 200 is mounted thereon.

The first and second screw holes 230 and 141 are formed at positions the first and second screw holes 230 and 141 meet when the sensor 200 is mounted on the front bulkhead 100. Then, since the first and second screw hole 141 form a continuous screw hole, a screw can be fastened to the one screw hole the first and second screw holes 141 form after the sensor 200 is fastened by using the first fastening means. Thus, the sensor 200 can be mounted to the front bulkhead 100, more firmly.

After the sensor 200 is mounted on the bulkhead 100 by using the first and the second fastening means, the air outlet grill 300 is mounted on the front bulkhead 100. Referring to FIG. 3, when it is intended to mount the air outlet grill 300, the first pass through holes 320 in the air outlet grill 300 and the second pass through holes 160 in the front bulkhead 100 are aligned, and fastens with fastening members, such as screws. One of the second pass through holes 160 can be provided to the second mounting bracket 140 as shown in FIGS. 5 and 6.

Figure 8:
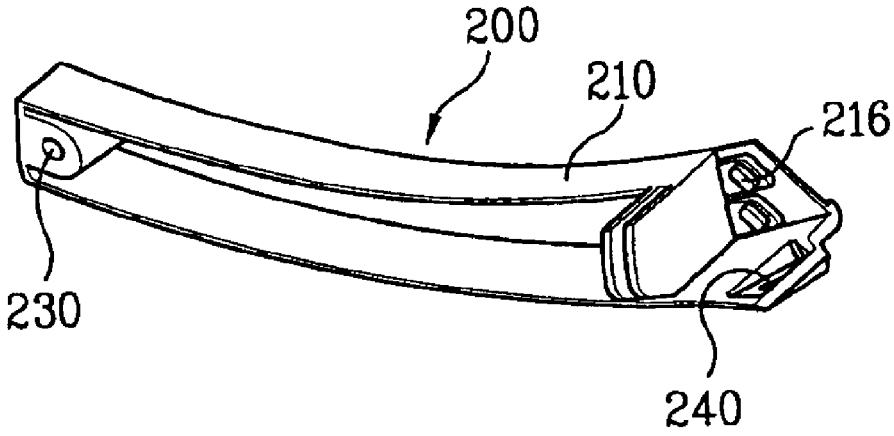
FIG. 8 illustrates a perspective view showing a sensor in accordance with a second preferred embodiment of the present invention.
Figure 9:
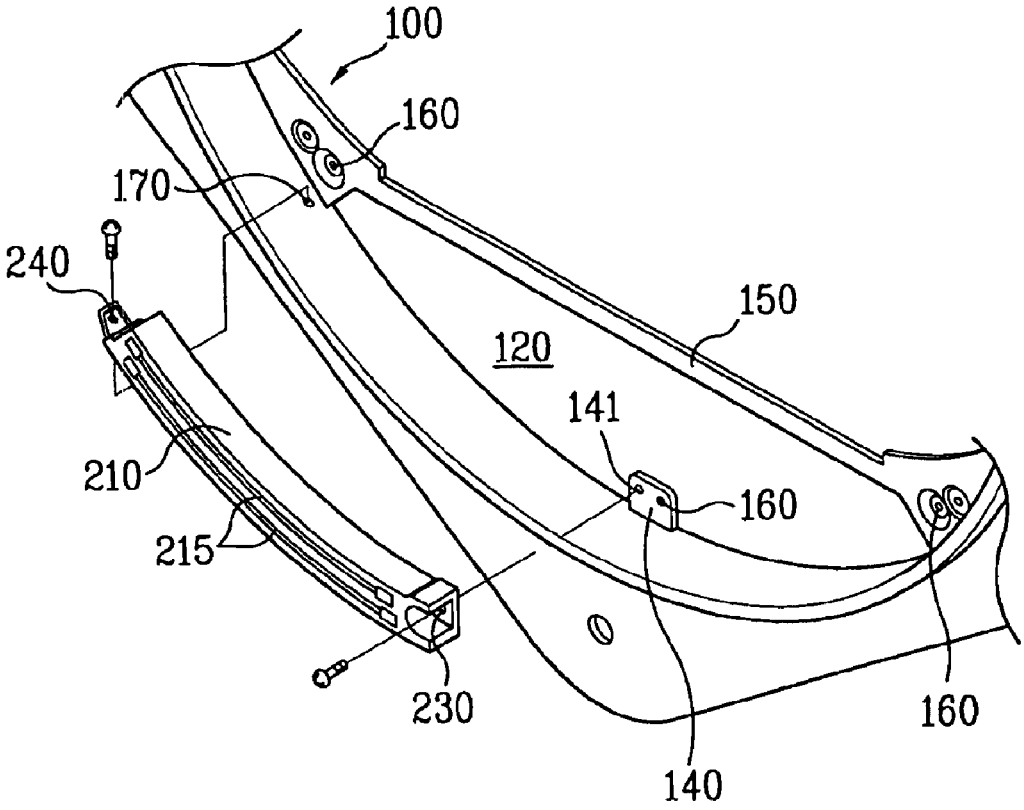
FIGS. 9 and 10 illustrate perspective views each seen from an inside of a drum showing the sensor in FIG. 8 mounted on a front bulkhead.
Figure 10:
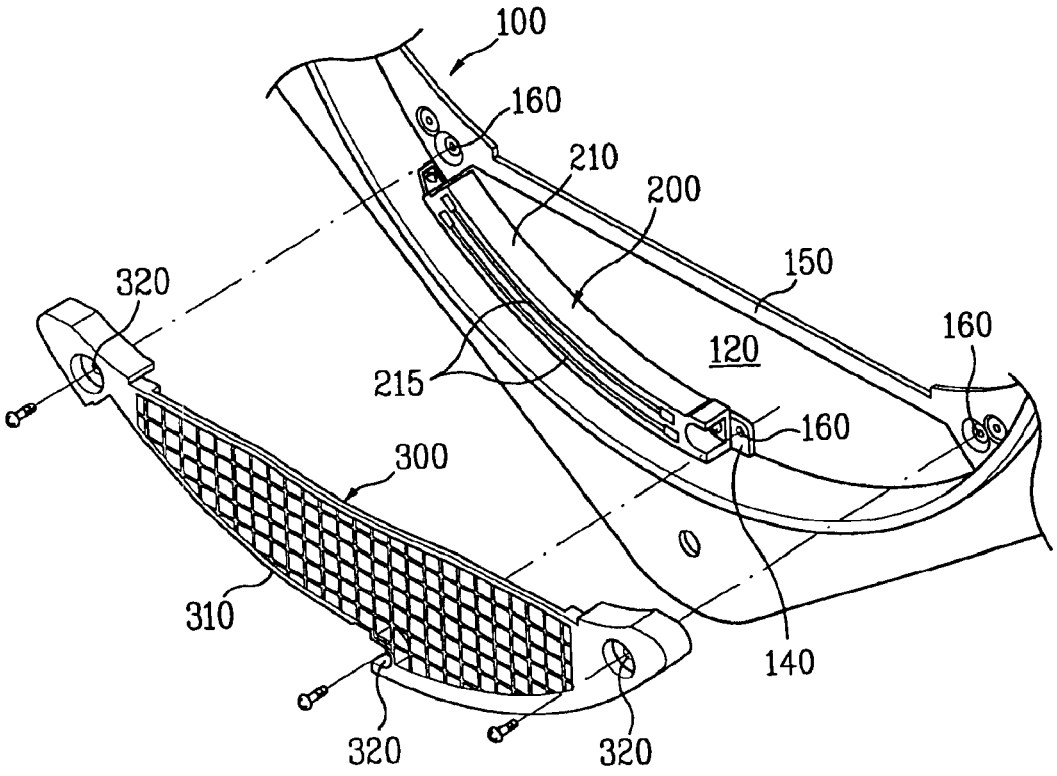

In the meantime, FIGS. 8~10 illustrate a second embodiment of the present invention, which will be described in detail, with reference to the drawings.

The sensor 200 in the embodiment illustrated in FIGS. 8~10 includes fastening means having second fastening means and third fastening means. As shown in FIGS. 8~10, the second fastening means has a first screw hole 230 in one side part of the sensor 200, which is identical to an example described in association with FIGS. 5 and 6, and description of which will be omitted. The third fastening means will be described, hereafter.

The third fastening means 200 includes a third screw hole 240 provided to the other end of the sensor 200, i.e., an end opposite to an end the first screw hole 230 is provided thereto. While the first screw hole 230 vertically passes through a surface the electrodes 215 are provided thereto and is in communication with the second screw hole 141 in the second mounting bracket 140 extended in a vertical direction from the inside circumferential surface of the front bulkhead 100, i.e., the surface the sensor 200 is mounted thereon, the third screw hole 240 is in communication with a fourth screw hole 170 which vertically passes through the surface the sensor 200 is mounted thereon and is provided to the inside circumferential surface of the front bulkhead 100 as shown in FIG. 9.

Once the sensor 200 has the second screw hole 141 and the third screw hole 240, opposite ends of the sensor 200 can be respectively fastened to the second mounting bracket 140 extended for the front bulkhead 100 and the inside circumferential surface of the front bulkhead 100 with screws or the like, firmly.

In this embodiment too, the air outlet grill 300 is mounted to the front bulkhead 100 so as to cover the air outlet opening 120 after the sensor 200 is mounted, of which detailed description will be omitted as the description is the same with before.

Figure 11:
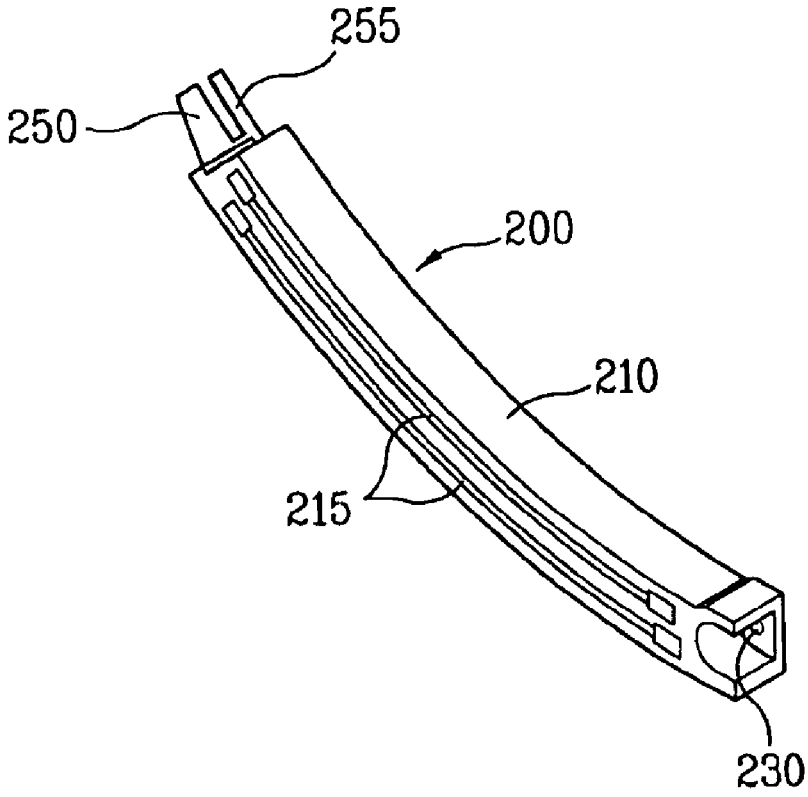
FIG. 11 illustrates a perspective view showing a sensor in accordance with a third preferred embodiment of the present invention.
Figure 12:
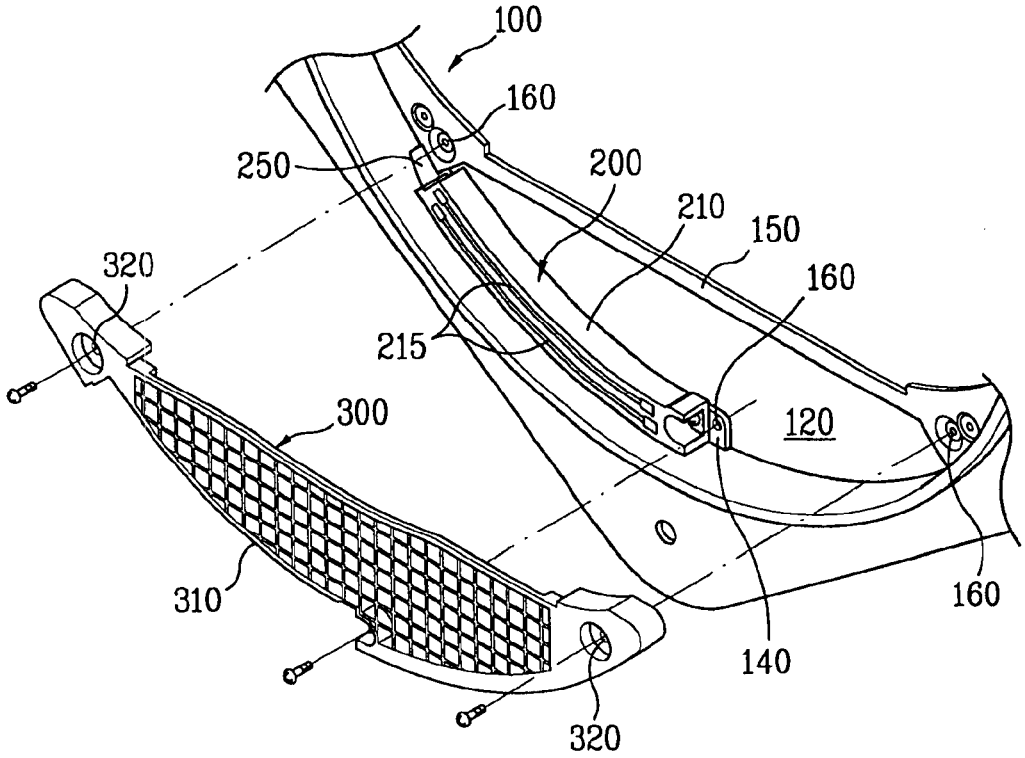
FIG. 12 illustrates a perspective view seen from an inside of a drum showing the sensor in FIG. 11 mounted on a front bulkhead.

FIGS. 11 and 12 illustrate a third preferred embodiment of the present invention, which will be described in detail with reference to the drawings.

In the embodiment illustrated in FIGS. 11 and 12, the sensor 200 includes fastening means having second fastening means and third fastening means. The second fastening means, having the first screw hole 230 provided to one side part of the sensor 200, is identical to the embodiments described with reference to FIGS. 5~10, and of which description will be omitted. The third fastening means will be described.

In the third embodiment of the present invention, the third fastening means includes a slot 230 provided in an up and down direction in the other end of the sensor 200, i.e., an end opposite to an end the first screw hole 230 is formed therein. FIG. 11 or 12 illustrates an embodiment in which the slot 255 is provided to a third plate 250 extended from the other end of the sensor 200 in parallel to the inside circumferential surface of the front bulkhead 100, i.e., a surface the sensor is mounted thereon. Once the third embodiment has the foregoing system, no separate fastening member is required for fastening the other end of the sensor 200, which will be described.

After the sensor 200 is brought into contact with the front bulkhead 100, a thin part of the front bulkhead 100, for an example, an end of a side the slot 255 is provided thereto, is pushed up toward a corner part where the inside circumferential surface of the front bulkhead 100 and the dividing member 150 are joined. Then, as shown in FIG. 12, since a part of the front bulkhead 100 is inserted in the slot 255, the sensor 200 can not move in a direction excluding a length or up and down direction of the slot 255. It is preferable that a width of the slot 255 is equal to or slightly smaller than a thickness of the corner part where the inside circumferential surface of the front bulkhead 100 and the dividing member 150 are joined. In a state a part of the front bulkhead 100 is inserted in the slot 255, when a screw or the like is fastened to the first screw hole 230 and the second screw hole 141, the sensor 200 is mounted, firmly.

In the third embodiment too, the air outlet grill 300 is mounted to the front bulkhead 100 after the sensor 200 is mounted, description of which will be omitted since the description is the same with the previous description. Anyhow, after the air outlet grill 300 is mounted, a more stable mounting state of the sensor 200 can be maintained, undoubtedly.

In the meantime, FIGS. 3~12 illustrate examples in which the second fastening means includes the first screw hole 230 which passes through one end of the sensor 200 directly, the second screw hole 141 in correspondence to the first screw hole 230 is provided to the second mounting bracket 140 extended from the inside circumferential surface of the front bulkhead 100, and, along with this, the second mounting bracket 140 is provided with the second screw hole 141 for mounting the sensor 200, and the second pass through hole 160 for mounting the air outlet grill 300. However, in the first, second, or third embodiment, the second fastening means is not limited to the examples illustrated in FIGS. 3~12. Other example of the second fastening means in the first, second, or third embodiment of the present invention will be described, with reference to FIG. 13.

Though, in the example described with reference to FIGS. 3 to 12, the second mounting bracket 140 is provided with two holes, i.e., the second screw hole 141 and the second pass through hole 160, in the example in FIG. 13, the second mounting bracket 140 is provided with one hole, i.e., a second pass through hole 160, only.

Figure 13:
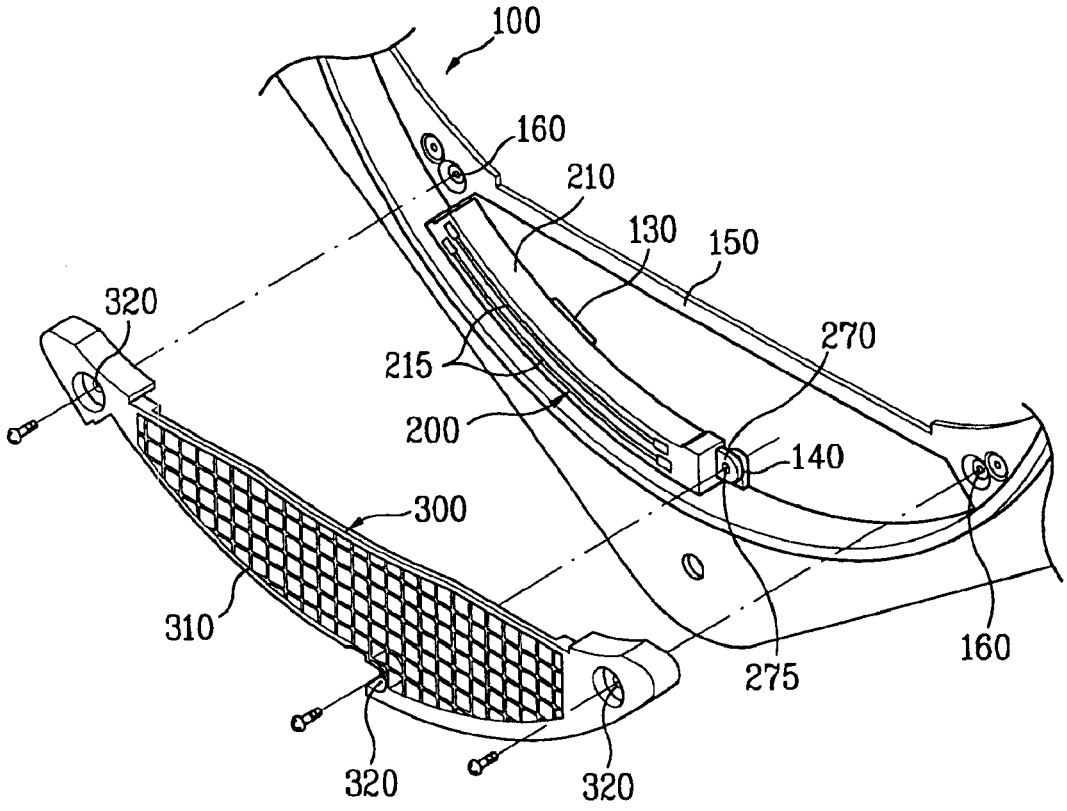
FIG. 13 illustrates a perspective view seen from an inside of a drum showing a sensor another embodiment of the second fastening means applied thereto mounted on a front bulkhead, together with an air outlet grill, in accordance with a first, second, or third preferred embodiment of the present invention.

In the embodiment illustrated in FIG. 13, the first screw hole 230 provided for fastening one end of the sensor 200, the first pass through hole for fastening the air outlet grill 300, and the second pass through hole 160 provided to the second mounting bracket 140 are designed to receive one fastening member, for an example, a screw, at the same time. To do this, the first screw hole 230 is provided such that the first screw hole 230 pass through a thin fourth plate 270 extended from the one end of the sensor 200.

Once the first screw hole 230 is provided thus, after sensor 200 is disposed such that the first screw hole 230 and the second screw hole form one hole, and the first pass through hole in the air outlet grill 300 and the first screw hole 230 are aligned, the holes are fastened with one screw, to mount the sensor 200 and the air outlet grill 300 to the front bulkhead 100, firmly. Of course, it is preferable that, before above fastening, the sensor 200 is fastened in advance by using the first or third fastening means provided to the sensor 200.

Thus, the second fastening means may differ from the embodiments illustrated in FIGS. 3~12. Therefore, the examples shown in FIGS. 3~12 are exemplary, but not limit the second fastening means.

Figure 14:
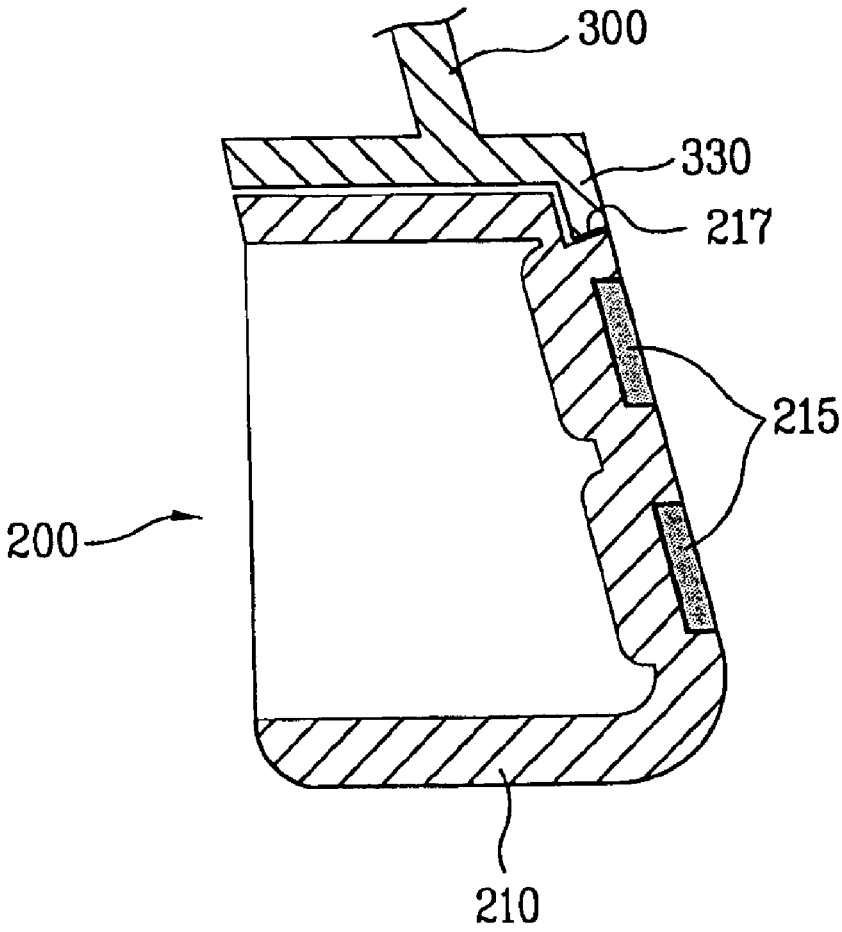
FIG. 14 illustrates a section showing a sensor mounted in accordance with a fourth preferred embodiment of the present invention.
Figure 15:
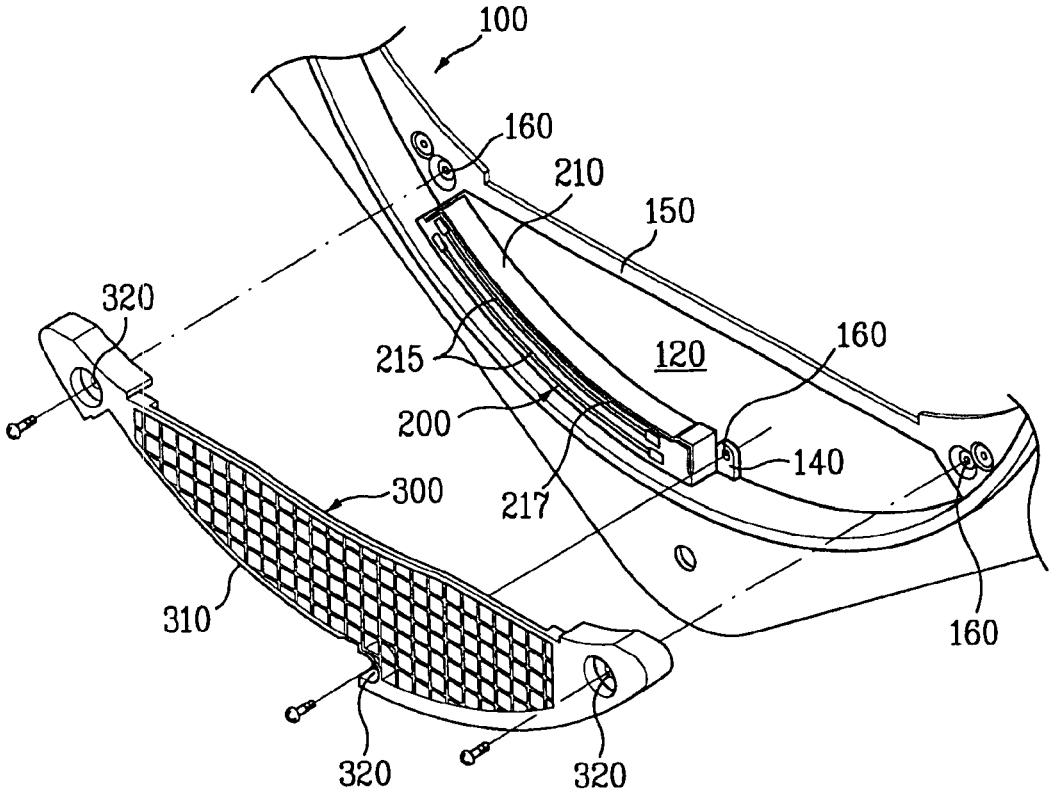
FIG. 15 illustrates a perspective view showing the sensor in FIG. 14 being mounted.

In the meantime, FIGS. 14 and 15 illustrate a fourth preferred embodiment of the sensor mounting structure of the present invention, which will be described in more detail.

Referring to FIGS. 14 and 15, the fastening means provided to the fourth embodiment includes a groove 217 in an upper surface of the sensor 200. The groove 217 is provided as the fastening means in the fourth embodiment in a recess form along upper and side edges of the sensor 200 as shown in FIG. 15, for engagement with a part of the air outlet grill 300 as shown in FIG. 14. For engagement with the groove 217 in the sensor 200, the caved channel is provided with a long ridge 330.

Once the groove 217 and the ridge 330 are provided to the sensor 200 and the air outlet grill 300 respectively, without using a separate fastening member, such as a screw, the sensor 200 can be mounted to the inside circumferential surface of the front bulkhead 100. That is, as shown in FIG. 14, if the air outlet grill 300 is fastened after positioning the sensor 200 at the inside circumferential surface of the front bulkhead 100, the ridge 330 of the air outlet grill 300 is engaged with the groove 217 in the sensor 200 such that the sensor 200 is locked by the caved channel 310 of the air outlet grill 300, to limit movement of the sensor 200 and maintain a fastened state by a friction force. In the meantime, as shown in FIG. 14, if a top surface of the groove 217 and a bottom surface of the ridge 330, which engage with each other, are sloped, a width direction movement of the sensor 200 can be prevented more effectively.

In the meantime, though not shown, in the fourth embodiment, more than one of the first, second, third fastening means described with reference to FIGS. 3~13 may be provided for firmer fastening of the sensor 200.

In the meantime, as shown in FIG. 14, the surface the electrodes 215 are provided thereto may have a sloped surface. Such embodiment is not limited to the fourth embodiment, but applicable to the first, second, and third embodiments. As shown in FIG. 14, the sloped surface has a lower part projected inward more than an upper part. Such a sloped surface of the sensor 200 permits more positive contact with the drying object, thereby improving a performance for sensing dryness of the drying object.

The present invention that can be realized in a variety of embodiments thus has a structure in which the sensor 200 is fabricated separate from the air outlet grill 300, and the sensor 200 and the air outlet grill 300 are mounted to the front bulkhead 100 respectively.

Since the sensor 200 and the air outlet grill 300 of the present invention have very simple structures, molding thereof is very easy. Also, since mounting structures of the sensor 200 and the air outlet grill 300 to the front bulkhead 100 are very simple, assembly is simple.

The separate fabrication and mounting of the sensor 200 and the air outlet grill 300 on the front bulkhead 100 permits replacement of the sensor 200 only when the sensor 200 is out of order without replacement of other components, which is very economic.

Moreover, since the foregoing sensor mounting structure requires no special design change or re-design of peripheral components even in a case mounting of a different kind of sensor is required depending on models of the dryer in production of the dryer, only to require fabrication of the sensor in the same form, the present invention is very economical.

When the dryer of the present invention having the sensor 200 mounted thereon is put into operation to dry the drying object, the sensor 200 senses information, such as humidity in the drum 20, and transmits to the controller of the dryer. The controller, having received the information from the sensor 200, determines an extent of progress of the present drying from the information, and selects an operation method suitable to the extent of the progress, and controls various components.

When feed back is made thus, the controller re-determines a heating rate of the heater, a blowing rate and speed of the blower, rotation speed of the drum, a drying time period, and the like depending on the extent of dryness of the drying object in the drum 20, and controls the dryer.

That is, if the extent of drying progress of the drying object is later than expectation after drying the drying object for a certain time period, the heating rate of the heater, the blowing rate of the blower, rotation speed of the drum, and the like are increased for fast drying.

Opposite to this, if the extent of drying progress of the drying object is faster than expectation after drying the drying object for a certain time period, the heating rate of the heater, the blowing rate of the blower, rotation and speed of the drum are decreased for slow down of the drying.

Upon completion of the drying, the sensor 200 senses it, and the controller stops operation, to prevent unnecessary excessive operation in advance.

Thus, the dryer of the present invention having the optimal feed back system always permits to progress an optimal drying, and reduce a drying time period and energy consumption by using the foregoing principle.

In the meantime, the device of the present invention having the sensor 200 which can sense information on an inside of the drum 20 provided thereto is applicable, not only to the dryer, but also to a drum type washing machine having a drying function.

The present invention has the following advantages.

First, the availability of easy realization of the feed back system at the dryer and drum type washing machine, permitting the controller to control components proper to an extent of drying progress of the drying object, can always provide an optimal dry service.

Second, the prevention of unnecessary excessive operation permits to shorten a drying time period, and reduce energy consumption.

Third, the very simple shapes of the sensor body and the air outlet grill permits easy formation of molds thereof, and the very simple assembly structure thereof with the front bulkhead provides a good assembly work.

Fourth, a component replacing cost can be saved, since what is required is replacement of the sensor only when the sensor is out of order.

Fifth, in designing a dryer or a drum type washing machine having another kind of sensor to be applied thereto, because what is required is fabrication of the sensor having the same shape, design change of the appliance is very simple and a new appliance can manufactured at a low cost.

It will be apparent to those skilled in the art that various modifications and variations can be made in the present invention without departing from the spirit or scope of the invention.

For an example, the fastening means for the sensor is not limited to the embodiments described with reference to FIGS. 3~15, but may be available as many as one wishes by combinations of the different embodiments. That is, though not shown, an embodiment of the fastening means for the sensor including first fastening means having an extension member, and third fastening means having a third screw hole can be possible.

Thus, it is intended that the present invention cover the modifications and variations of this invention provided they come within the scope of the appended claims and their equivalents.

What is claimed is:

1. A sensor assembly for an automatic laundry dryer having a rotatable drum, the sensor assembly comprising:

a bulkhead having an air outlet opening that exhausts humidified air from the drum;

an electrically non-conductive sensor body secured directly to the bulkhead, the sensor body being positioned so as to cover a portion of the air outlet opening;

at least one sensing element disposed on a first surface of the sensor body, the at least one sensing element being exposed to the inside of the drum such that wet clothes contact the at least one sensing element during dryer operation; and an air outlet grill secured to the bulkhead, wherein the air outlet grill receives the senior body.

2. The sensor assembly of claim 1 further comprising:

a first mounting bracket extending from the bulkhead where the a first mounting bracket includes an aperture disposed therein, wherein the sensor body includes an extension member extending from a second surface of the sensor body and wherein the extension member inserts into the aperture such that the extension member is in slip fit engagement with the first mounting bracket.

3. The sensor assembly of claim 2 further comprising:

a second mounting bracket extending from the bulkhead, wherein a first end of the sensor body includes a screw hole adapted to receive a screw for securing the first end to the second mounting bracket.

4. The sensor assembly of claim 2, wherein the extension member of the sensor body includes a detent which engages with the first mounting bracket to prevent the extension member from being disengaged from the first mounting bracket.

5. The sensor assembly of claim 1, wherein the sensor body further comprises:

a first screw hole disposed in a first end of the sensor body adapted to receive a first screw for securing the first end directly to the bulkhead; and a second screw hole disposed in a second end of the sensor body adapted to receive a second screw for securing the second end to a mounting bracket which extends from the bulkhead.

6. The sensor assembly of claim 1, wherein a first end of the sensor body includes a slot adapted to receive a thin portion of the bulkhead where the sensor body is secured to the bulkhead when the slot receives the thin portion of the bulkhead and wherein a second end of the sensor body includes a screw hole adapted to receive a screw for securing the second end to a mounting bracket which extends from the bulkhead.

7. The sensor assembly of claim 1, wherein the air outlet grill covers the remaining portion of the air outlet opening.

8. The sensor assembly of claim 7, wherein the air outlet grill includes a plurality of screw holes adapted to receive a plurality of screws such that the plurality of screws secure the air outlet grill to the bulkhead.

9. The sensor assembly of claim 7, wherein the air outlet grill includes a caved channel formed on a lower circumferential edge of the air outlet grill for receiving the sensor body.

10. The sensor assembly of claim 9, wherein the sensor body includes a groove formed on an upper edge of the first surface and the air outlet grill includes a ridge that engages with the groove for pressing down the upper edge of the first surface so as to prevent disengagement of the sensor body from the caved channel of the air outlet grill.

11. The sensor assembly of claim 9, wherein the first surface of the sensor body slopes away from a surface of the air outlet grill thereby projecting into the inside of the drum for improved contact with wet clothes.

12. The sensor assembly of claim 1, wherein the first surface of the sensor body slopes away from the bulkhead thereby projecting into the inside of the drum for improved contact with wet clothes.

13. An automatic dryer, comprising:

a cabinet;

a drum rotatably provided in the cabinet for containing a load of wet clothes to be dried;

a rear bulkhead comprising an air inlet opening that exhausts dry air into the drum;

a front bulkhead comprising an air outlet opening that exhausts humidified air from the drum;

an electrically non-conductive sensor body secured directly to the front bulkhead, the sensor body being positioned so as to cover a position of the air outlet opening;

at least one sensing element disposed on a first surface of the sensor body, the at least one sensing element being exposed to the inside of the drum such that wet clothes contact the at least one sensing element during dryer operation; and a perforated air outlet grill being rigidly secured to the front bulkhead and covering the remaining portion of the air outlet opening, wherein the perforated air outlet grill is configured to receive the sensor body.

14. The automatic dryer of claim 13 further comprising:

a first mounting bracket extending from the front bulkhead, where the first mounting bracket includes an aperture disposed therein, wherein the sensor body includes an extension member extending from a second surface of the sensor body and wherein the extension member inserts into the aperture such that the extension member is in slip fit engagement with the first mounting bracket.

15. The automatic dryer of claim 14 further comprising:

a second mounting bracket extending from the front bulkhead, wherein a first end of the sensor body includes a screw hole adapted to receive a screw for securing the first end to the second mounting bracket.

16. The automatic dryer of claim 14, wherein the extension member of the sensor body includes a detent which engages with the first mounting bracket the extension member from the first mounting bracket.

17. The automatic dryer of claim 13, wherein the sensor body further comprises:

a first screw hole disposed in a first end of the sensor body adapted to receive a first screw for securing the first end directly to the front bulkhead; and a second screw hole disposed in a first end of the sensor body adapted to receive a second screw for securing the second end to a mounting bracket which extends from the front bulkhead.

18. The automatic dryer of claim 13, wherein a first end of the sensor body includes a slot adapted to receive a thin portion of the front bulkhead where the sensor body is secured to the front bulkhead when the slot receives the thin portion of the front bulkhead, and wherein a second end of the sensor body includes a screw hole adapted to receive a screw for securing the second end to a mounting bracket which extends from the front bulkhead.

19. The automatic dryer of claim 13, wherein die air outlet grill includes a plurality of screw holes adapted to receive a plurality of screws such that the plurality of screws secure the air outlet grill to the front bulkhead.

20. The automatic dryer of claim 13, wherein the air outlet grill includes a caved channel formed on a lower circumferential edge of the air outlet grill for receiving the sensor body.

21. The automatic dryer of claim 20, wherein the sensor body includes a groove formed on an upper edge of the first surface and the air outlet grill includes a ridge that engages with the groove for pressing down the upper edge of the first surface so as to prevent disengagement of the sensor body from the caved channel of the air outlet grill.

22. The automatic dryer of claim 20, wherein the first surface of the sensor body slopes away from a surface of the air outlet grill thereby projecting into the inside of the drum for improved contact with wet clothes.

23. The automatic dryer of claim 13, wherein the first surface of the sensor body slopes away from the front bulkhead thereby projecting into the inside of the drum for improved contact with wet clothes.

* * * * *